United States Patent [19]

Schwartz et al.

[11] Patent Number: 4,987,835

[45] **Date of Patent: * Jan. 29, 1991**

[54] AUTOMATIC VERTICALLY ADJUSTABLE WORK SURFACE

[75] Inventors: Edward M. Schwartz, Kansas City; Wilburn D. Everman, Belton, both of Mo.

[73] Assignee: Edtech Company, Kansas City, Mo.

[ * ] Notice: The portion of the term of this patent subsequent to Nov. 21, 2006 has been disclaimed.

[21] Appl. No.: 430,556

[22] Filed: Nov. 1, 1989

Related U.S. Application Data

[63] Continuation-in-part of Ser. No. 268,415, Nov. 8, 1988.

[51] Int. Cl.[5] ..... A47B 9/12

[52] U.S. Cl. ..... 108/144; 248/244; 108/147

[58] Field of Search ..... 108/144, 147, 42, 44, 108/152, 108; 248/243, 244, 295.1

[56] References Cited

U.S. PATENT DOCUMENTS

| | | | |
|---|---|---|---|
| 1,527,895 | 2/1925 | Mazoch | 108/147 |
| 3,982,801 | 9/1976 | Heidorn et al. | 108/147 |
| 4,604,956 | 8/1986 | Grebel et al. | 108/147 |
| 4,619,208 | 10/1986 | Kurrasch | 108/147 X |
| 4,627,364 | 12/1986 | Klein | 108/147 |
| 4,651,652 | 3/1987 | Wyckoff | 108/144 |
| 4,881,471 | 11/1989 | Schwartz et al. | 108/144 |

*Primary Examiner*—Peter A. Aschenbrenner
*Attorney, Agent, or Firm*—Sughrue, Mion, Zinn, Macpeak & Seas

[57] ABSTRACT

A vertically adjustable work station including a first pair of vertically oriented, spaced rails (5) to be stationarily mounted on an existing wall panel (1) of a conventional work station, a second pair of vertically oriented rails (6) individually, slidably, interlockingly disposed in the first pair of rails (5), a pair of support brackets (3) having engaging teeth (17) protruding therefrom so as to be individually mounted on the second pair of rails (6), a work surface (4) supported by the support brackets (3), a pair of interconnecting channels (8) for respectively interconnecting the first and second pairs of rails (5, 6) and a drive mechanism coupled between the interconnecting channels to move the channels toward or away from each other so as to attendantly displace the work surface (4).

21 Claims, 11 Drawing Sheets

AUTOMATIC VERTICALLY ADJUSTABLE WORK SURFACE

CROSS REFERENCE TO RELATED APPLICATION

This is a Continuation-in-Part application of pending application U.S. Ser. No. 268,415 filed Nov. 8, 1988.

FIELD OF THE INVENTION

The invention relates to a work station having an automatically vertically adjustable work surface to accommodate workers of different heights.

BACKGROUND OF THE INVENTION

There are at least 10 million video display terminals (hereinafter referred to as VDTs) in use across the country, and it is predicted that there will be at least 40 million VDTs by the end of this decade. While VDTs are used for a variety of tasks, they are used most intensively by a range of office workers who may spend the entire day key-punching and processing information. VDTs have been instrumental in increasing productivity and efficiency for virtually every major industry, and will continue to play a central role in this country's economy.

However, as the number of VDTs in the work place has risen, so have the health complaints associated with their use. Surveys indicate that a majority of full-time VDT users report high frequencies of health problems. Among other problems, recent studies confirm that VDT users have higher incidences of problems such as eye strain, headaches, insomnia, back and neck strain and fatigue.

As these health concerns have been recognized as legitimate and serious, steps are being taken in at least twenty states to introduce legislation to institute health and safety protections for VDT users. While questions have been raised regarding whether VDTs emit harmful radiation, studies show that the radiation levels emitted by the VDTs are well below levels naturally found in the environment. Thus, it is generally concluded that radiation is not the primary cause of the physical problems discussed above. In contrast, numerous studies have indicated that operator injury such as carpal tunnel syndrome and tenosynovitis, which are cumulative trauma injuries, are caused by improper VDT work station design.

In particular, the conventional VDT work station is designed such that the work surfaces cannot be adjusted to accommodate people of different height. Shorter people must arch their body and elevate their arms in order to properly operate the keyboard and view the display terminal. In contrast, taller people have to hunch over to access the keyboard and view the terminal. Accordingly, the conventional VDT work stations have resulted in a high frequency of health-related problems.

FIG. 1 illustrates the conventional video display terminal work station. As shown in FIG. 1, the conventional work station includes a plurality of interconnected panels 1 having a plurality of elongate vertically extending support rails 2. Each of the support rails 2 includes a plurality of slots disposed along the vertical length thereof. Support brackets 3, having a plurality of teeth protruding therefrom, are secured to the support rails 2 by inserting the teeth of the support brackets into the complimentary corresponding slots of the support rails 2. The work surface 4 is supported by a pair of the supporting brackets 3.

Thus, while the conventional work surface is vertically adjustable, such vertical adjustment can only occur by disassembling the table top from the brackets and vertically adjusting the location of the support brackets on the support rails. Accordingly, to vertically adjust the conventional work surface it is necessary to remove all items therefrom, including the video display terminal. It is therefore not practical to adjust the height of the work surface on an hourly or daily basis to accommodate a change in shift of workers of different heights. Therefore, rapid, automatic, vertical adjustment of the work surface is not possible resulting in an unhealthy working environment.

Further, Carpal Tunnel Syndrome (CTS) is an ailment affecting the wrists, arms and hands, which many times results from prolonged use of computer keyboards. The syndrome is named after the Carpal Tunnel which is located in the wrist and forms the passageway for passing nerves and tendons from the arm to the hand. When the wrist is bent, the Carpal Tunnel narrows and compresses the tendons and nerves. If the wrist is bent for a long period of time, the resulting compression may damage the tendons and nerves, resulting in the onset of CTS.

Even when the keyboard operator is in an ideal typing posture the operator's hands are bent slightly outward. When the operator is in a less than ideal posture further wrist bending is required to operate the keyboard. As described above, wrist bending that takes place over an extended period of time, as is usual with these types of jobs, results in prolonged compression of the nerves and tendons increasing the likelihood of protracting CTS.

SUMMARY OF THE INVENTION

It is an object of this invention to provide a retrofitting device for retrofitting an existing work station such that the work surface can be rapidly and automatically vertically adjustable.

It is a further object to provide a retrofitting device for retrofitting an existing work station such that the work surface can be vertically adjusted while the video display terminal is disposed thereon.

A further object is to provide an inexpensive retrofitting device for retrofitting a standard work station with a vertically adjustable work surface without requiring a redesign of the existing work station.

Further, another object is to provide a vertically adjustable work surface, permanently attached within a work station.

Another object is to insure that the operator correctly positions his hands vertically with respect to a keyboard placed on the work surface.

These and other objects which will become apparent from the ensuing description of the preferred embodiment of the invention are accomplished according to the present invention by a vertically adjustable, retrofittable work station adapted to be mounted to an existing wall panel. The retrofittable work station comprises a pair of horizontally spaced, vertically oriented support rails secured to the panel, a work surface, a first pair of elongate, vertically oriented, rails horizontally displaced from one another and adapted to be individually and stationarily mounted to the support rails, a second pair of elongate, vertically oriented, rails individually slidably mounted to the first pair of rails, means for individually mounting the support brackets and thus the work surface to the second pair of rails, a first elongate, horizontally oriented, channel member interconnecting the first pair of rails and a driving mechanism coupled between the first and second channel members for selectively displacing the channel members towards or away from each other to attendantly vertically displace the work surface. To allow for retrofit, the first pair of stationary rails have a plurality of teeth extending therefrom which are shaped and arranged in the same manner as the teeth which extend from the support bracket. In this manner, the stationary rails can be secured to the existing support rails. In addition, the second pair of slidably mounted rails have a plurality of slots corresponding to the slots in the existing support rails such that the existing support bracket can be secured to the slidable rails to thereby provide an automatically vertically adjustable work surface.

The above-described retrofit can be permanently installed by replacing the existing support rails with the stationary rails of the vertically adjustable work surface. In this arrangement, the stationary rails are fixedly attached to the panel, thus eliminating the need for the support rails, and providing a permanently attached work surface.

DESCRIPTION OF PREFERRED EMBODIMENTS

As discussed above and as shown in FIG. 1, the conventional work station includes a plurality of panels 1 serving as support means and interconnected by support rails 2 having slots disposed therein for receiving the correspondingly shaped teeth of the support bracket 3 for supporting the work surface 4. The retrofittable device of the invention is a vertically adjustable unit which is designed to be mounted on the existing support rails 2 and to support the existing support bracket 3 for supporting the work surface 4 in a vertically adjustable manner.

Figure 3:
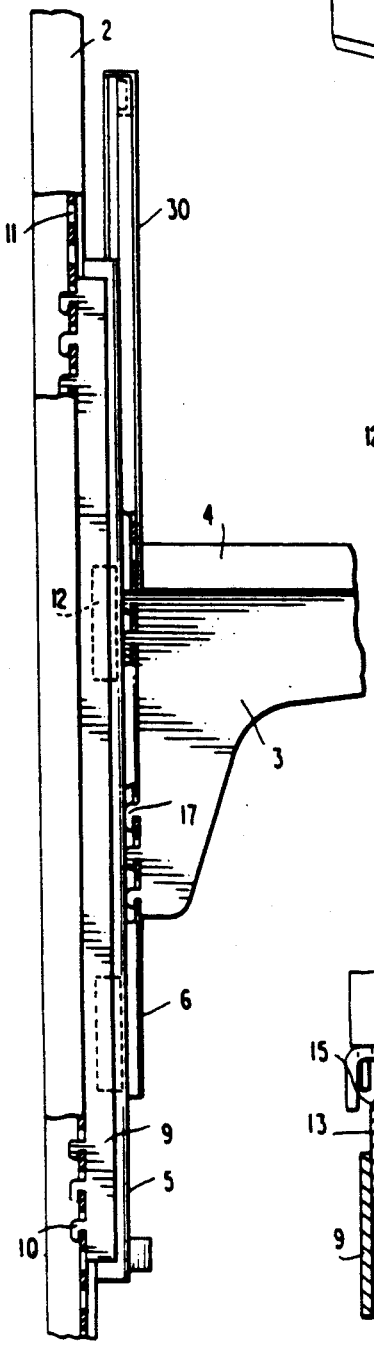
FIG. 3 is a side view of the vertically adjustable work station of the invention.
Figure 2:
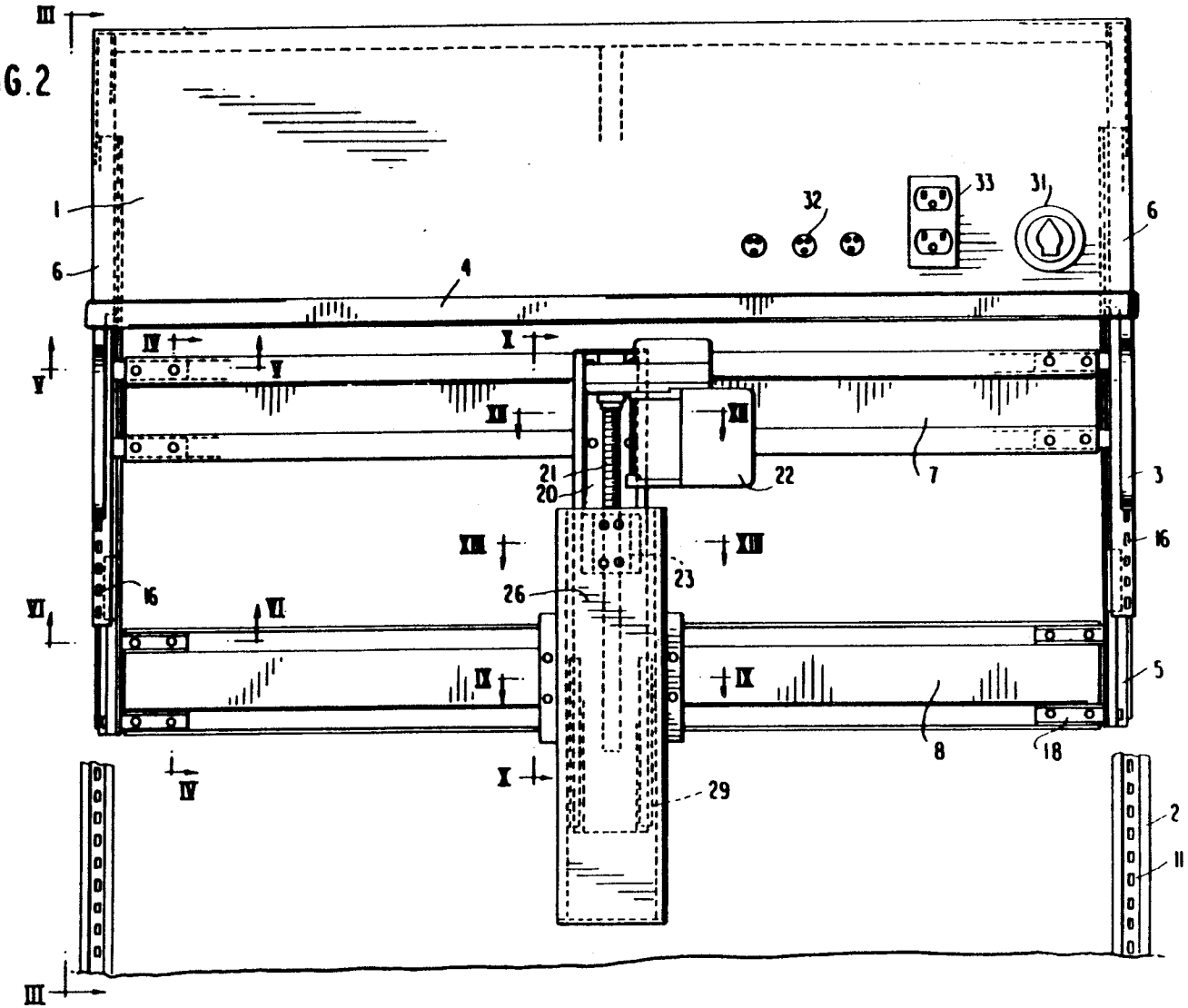
FIG. 2 a front view of the vertically adjustable, retrofittable work station of the present invention.
Figure 11:
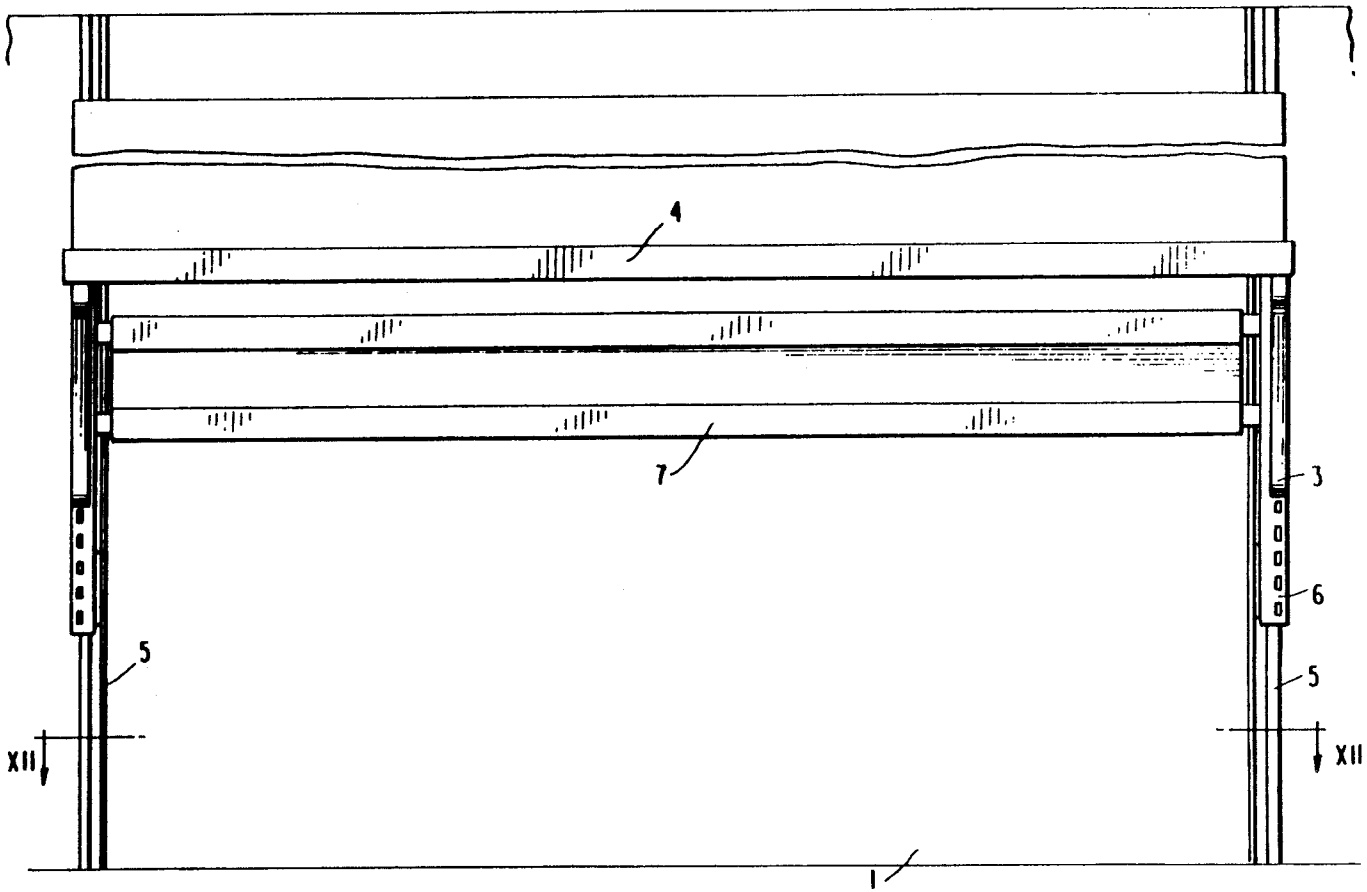
FIG. 11 is a front view of the vertically adjustable work station of the invention, permanently mounted to a panel.
Figure 12:
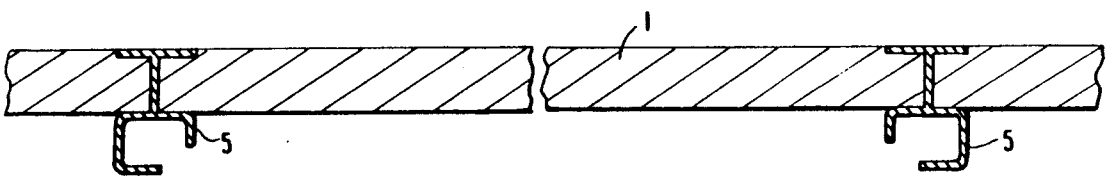
FIG. 12 is a sectional view taken along lines XII—XII of FIG 11.

Particularly, as shown in FIGS. 2 and 3, the retrofittable device of the invention comprises a pair of stationary rails 5 adapted to be mounted on the existing support rails 2, a pair of slidable rails 6 individually slidably disposed on the stationary rails 5, a slidable channel 7 connecting each of the slidable rails 6, a fixed channel 8 connecting each of the stationary rails 5, a slidable channel 7 connecting each of the slidable rails 6, a fixed channel 8 connecting each of the stationary rails 5, a support bracket 3 for supporting the work surface 4 and a driving mechanism coupled to the slidable channel 7 and fixed channel 8 for selectively displacing the channels towards or away from each other to attendantly vertically displace the work surface 4. Alternatively, the work surface may be permanently mounted to the work station panel, as shown in FIGS. 11 and 12. In this arrangement, the stationary rails 5 of the adjustable work surface replace the support rails 2 of the existing panel. In particular, the stationary rails 5 are permanently mounted to the panel in place of the support rails 2, so that the vertically adjustable unit is permanently attached to the existing panel. The securing plate 9, teeth 10, slots 11 of the existing vertical support rails 2, and the existing vertical support rails 2 are all thereby eliminated. Additionally, since the stationary rails are secured to and supported by the panel, the fixed channel 8 can also be eliminated.

Figure 5:
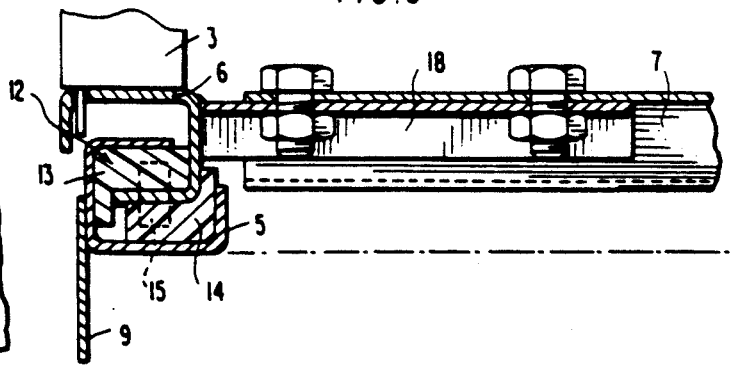
FIGS. 4, 5 and 6 are sectional views taken along the lines IV—IV, V—V AND VI—VI of FIG. 2, respectively.
Figure 6:
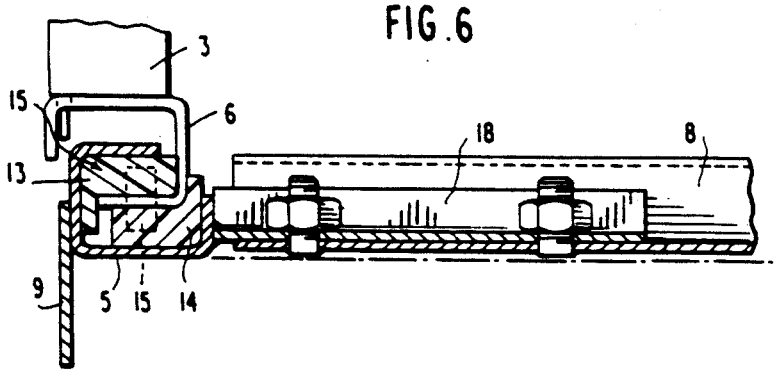

Referring to FIG. 3, the stationary rails 5 are vertically extending elongate members for securing the retrofittable device to the support rails 2 of the existing panel. In cross-section, the stationary rails 5 are substantially G-shaped as shown in FIGS. 5 and 6. Secured to each of the stationary rails 5 is an elongate securing plate 9 extending the length of the stationary rail 5. As shown in FIG. 3 the securing plate 9 has a plurality of engaging teeth 10 extending therefrom along the vertical length of the stationary rail 5. The teeth are shaped and arranged to correspond to the shape and arrangement of the teeth extending from the existing support bracket 3. Thus, the teeth 10 of the securing plates 9 are insertable into the slots 11 of the existing vertical support rails 2 in the same manner that the support brackets 3 are conventionally insertable into the slots 11 of the support rails so as to allow for the stationary rails 5, and hence the retrofittable device to be easily mounted to the existing rails 2.

The slidable rails 6 are also G-shaped in cross-sections to correspond to the shape of the stationary rails 5, a pair of sliding bushings 12 are secured to each of the slidable rails 6 at upper and lower portions thereof. Each of the bushings 12 comprise a pair of L-shaped substantially frictionless members 13, 14 which are interconnected such that one of the frictionless members 13 is disposed on the inside of the G-shaped slidable rail 6 while the other frictionless member 14 is disposed on the outside of the G-shaped slidable rail 6. The frictionless members 13, 14 are connected by dowel pins 15, screws or the like to the slidable rails 6. Thus, the frictionless members are fixedly attached to the slidable rails 6 so as to slide therewith relative to the stationary rails 5 to allow for smooth vertical adjustment of the slidable rails 6.

As shown in FIGS. 2 and 3, each of the slidable rails 6 has a plurality of slots 16 disposed along the length thereof. The slots 16 are shaped and arranged in the same manner as the slots 11 provided in the existing support rails 2. Accordingly, the existing support brackets 3 can be secured to the slidable rails 6 in the conventional manner by inserting the teeth 17 of the support brackets 3 into the complimentary slots 16 of the slidable rails 6.

Figure 4:
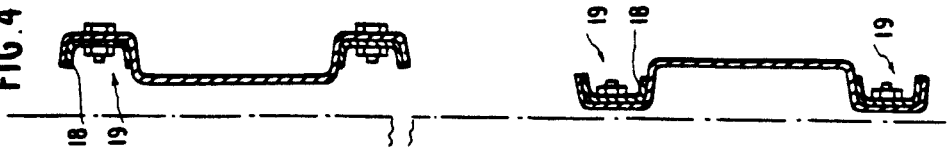
Figure 10:
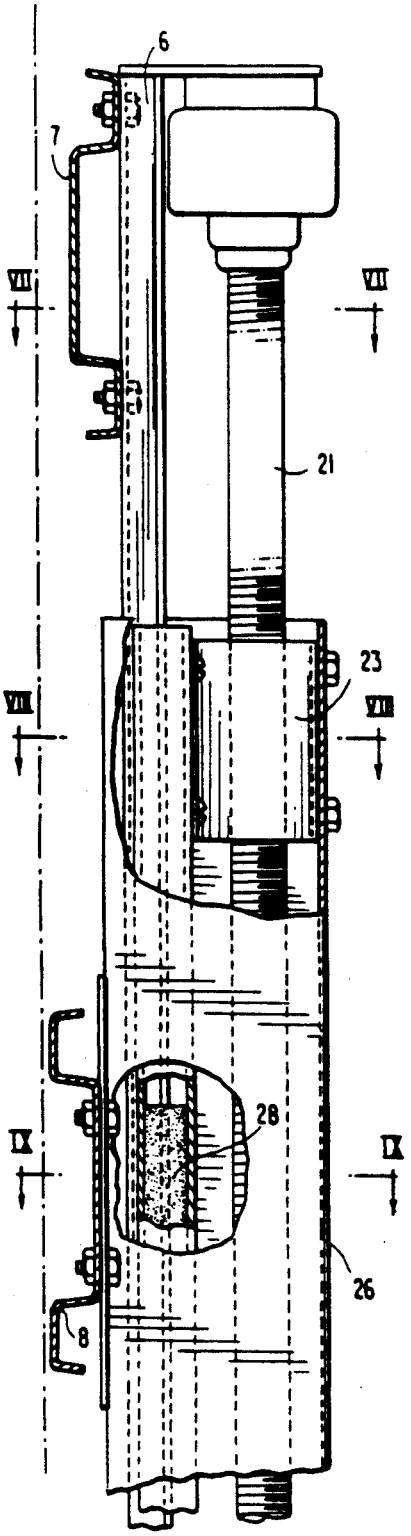
FIG. 10 is a sectional view taken along the line X—X of FIG. 2.
Figure 7:
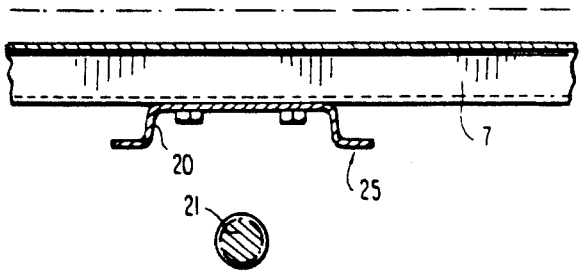
FIGS. 7, 8 and 9 are sectional views taken along the lines of VII—VII, VIII—VIII, and IX—IX of FIG. 2, respectively.

The slidable channel 7 and fixed channel 8 respectively interconnect the slidable rails 6 and the stationary rails 5, as illustrated in FIG. 2. That is, the slidable rails 6 are interconnected by the slidable channel 7 and the stationary rails 5 are interconnected by the fixed channel 8. The channels 7, 8 are dimensioned in length such that the overall width of the retrofittable device corresponds to the standard distance between existing support rails 2 in conventional work stations. For example, the distance between the support rails in standardized work stations is either 48 or 64 inches. Correspondingly, the channels are dimensioned such that the distance between the stationary rails is either 48 inches or 64 inches such that the retrofittable device can be used to retrofit any standard size work station. The slidable channel 7 and stationary channel 8 are respectively connected to the slidable rails 6 and the stationary rails 5 in the manner shown in FIGS. 2, 5 and 6. Specifically, each of the stationary rails 5 and slidable rails 6 include a pair of U-shaped connector links 18 extending perpendicularly therefrom. Referring to FIG. 4, the slidable rail 6 and stationary rail 5 are respectively secured to the slidable channel 7 and fixed channel 8 by respectively securing the pair of connector links 18 to the outer correspondingly U-shaped portions 19 of the W-shaped channels using screws or the like.

As shown in FIG. 4 and mentioned above the cross-sectional shape of each of the channels 7, 8 is in the form of a "W", which results in a high bending strength with a minimal weight. Of course, other cross-sectional shapes that result in high bending strength and minimal weight could be used instead.

Figure 1:
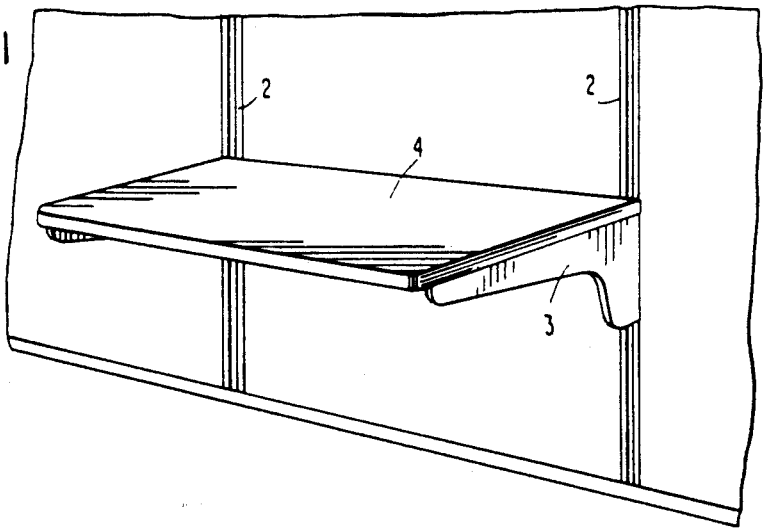
FIG. 1 is a perspective view of the conventional VDT work station.

As shown in FIGS. 1 and 3, the support brackets 3 are substantially L-shaped members having a plurality of teeth 17 protruding therefrom. The teeth 17 are engageable with the slots 16 of the slidable rails 6 such that the support brackets 3 extend perpendicularly from the slidable rails 6 away from the existing panel 1 to support the work surface 4 thereon.

Having fully described the overall structure of the retrofittable device, the driving and guide mechanism for selectively displacing the channels toward or away from each other to attendantly displace the work surface will be described hereinafter.

Figure 8:
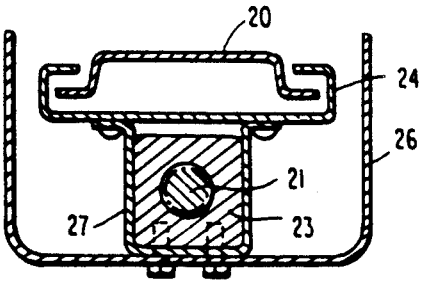
Figure 9:
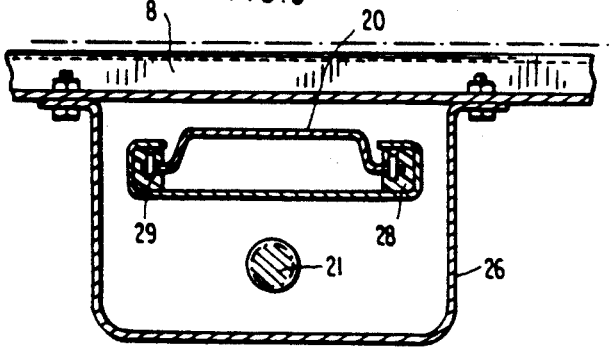

Referring to FIGS. 2 and 7–10, the driving/guide mechanism generally includes a slide plate 20, a drive screw 21 and a motor 22 secured to the slidable channel 7 as well as a drive nut 23 and a bearing bracket 24 fixedly attached to the fixed channel 8. The slide plate 20 is a substantially U-shaped plate which is fixedly secured to the slidable channel 7 at the top end of the slide plate 20 and which extends vertically downwardly therefrom. The slide plate 20 includes two flanges 25 on opposing sides thereof to which linear bearings 28 are individually attached. In particular, the linear bearings 28 are substantially rectangular in cross-section and include a slot extending longitudinally thereto in which the flanges are respectively secured. The linear bearings 28 are individually secured to the flanges 25 using a plurality of dowel pin 29 inserted into aligned holes in the linear bearing and the flange, as shown in FIG. 9. Of course, the linear bearing could be secured to the flange by any suitable manner. The linear bearings 28 are in sliding engagement with the bearing bracket in the manner described hereinafter.

The motor 22 is fixedly secured to the slidable channel 7 and includes the rotatable drive screw 21 extending vertically downwardly therefrom. The drive screw 21 is threadedly engaged with the drive nut 23 which is fixedly secured to the stationary channel 8 in the following manner.

A substantially U-shaped vertically extending cover 26 is secured to the stationary channel as shown in FIGS. 2. 9 and 10. The cover 26 extends downwardly a sufficient distance to cover the drive mechanism. Secured to the interior portion of the cover is a U-shaped inner bracket 27 for securing the drive nut 23 and the bearing bracket 24. Specifically, the drive nut 23 is secured to the interior portion of the inner bracket 27 using screws or the like. The drive nut 23 is oriented such that the axis of the threaded hole extends in vertical direction to receive the drive screw 21. One type of drive nut 23 is a Delcron drive nut having a low friction coefficient. In the case where the stationary rails 5 are mounted directly in the panel and the fixed channel is eliminated, the nut can be secured to the panel.

The bearing bracket 24 is secured to the inner bracket 27 as shown in FIG. 8. The bearing bracket 27 is substantially C-shaped and extends in the vertical direction. The outer portions of the bearing bracket are dimensioned to slidably receive the linear bearings 28 individually secured to the flanges 25 of the slide plate 20 in the manner described hereinabove. In this manner, the slide plate 20, in sliding contact with the bearing bracket 24, distributes the torsional force resulting from the torque of the drive screw to prevent any distortion of the device.

Accordingly, upon rotation of the drive screw, the slidable channel, and attendantly the slidable rails and the work surface, moves in the vertical direction to thereby adjust the elevation of the work surface.

Although the above embodiment describes the drive motor 22 secured to the slidable channel 7, an alternative arrangement, would be to eliminate the slidable channel 7, secure the drive motor to the underside of the work surface, and permanently secure the work surface to the slidable rails.

Figure 13:
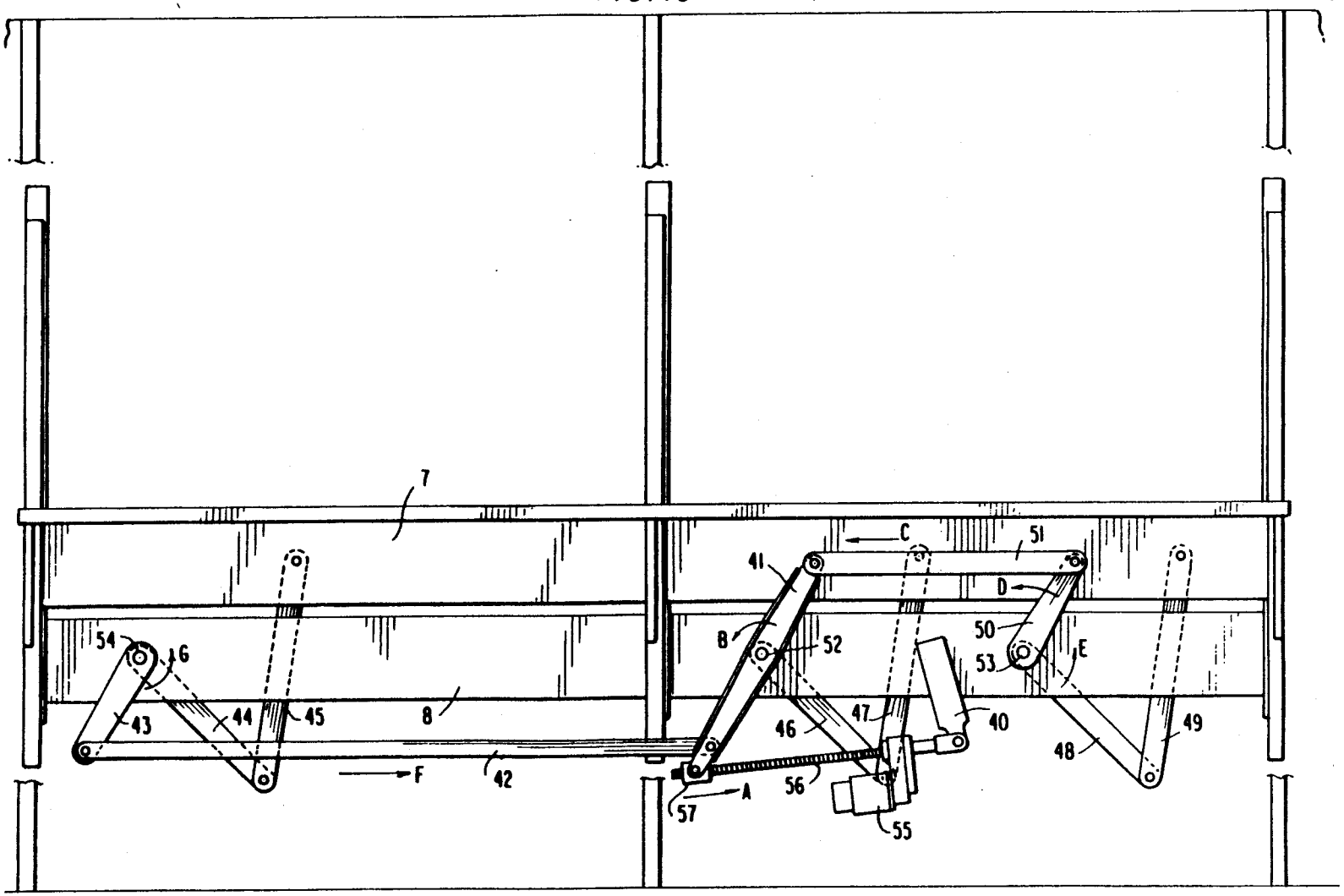
FIGS. 13 and 14 are front views of the vertically adjustable work surface with a linkage drive.
Figure 14:
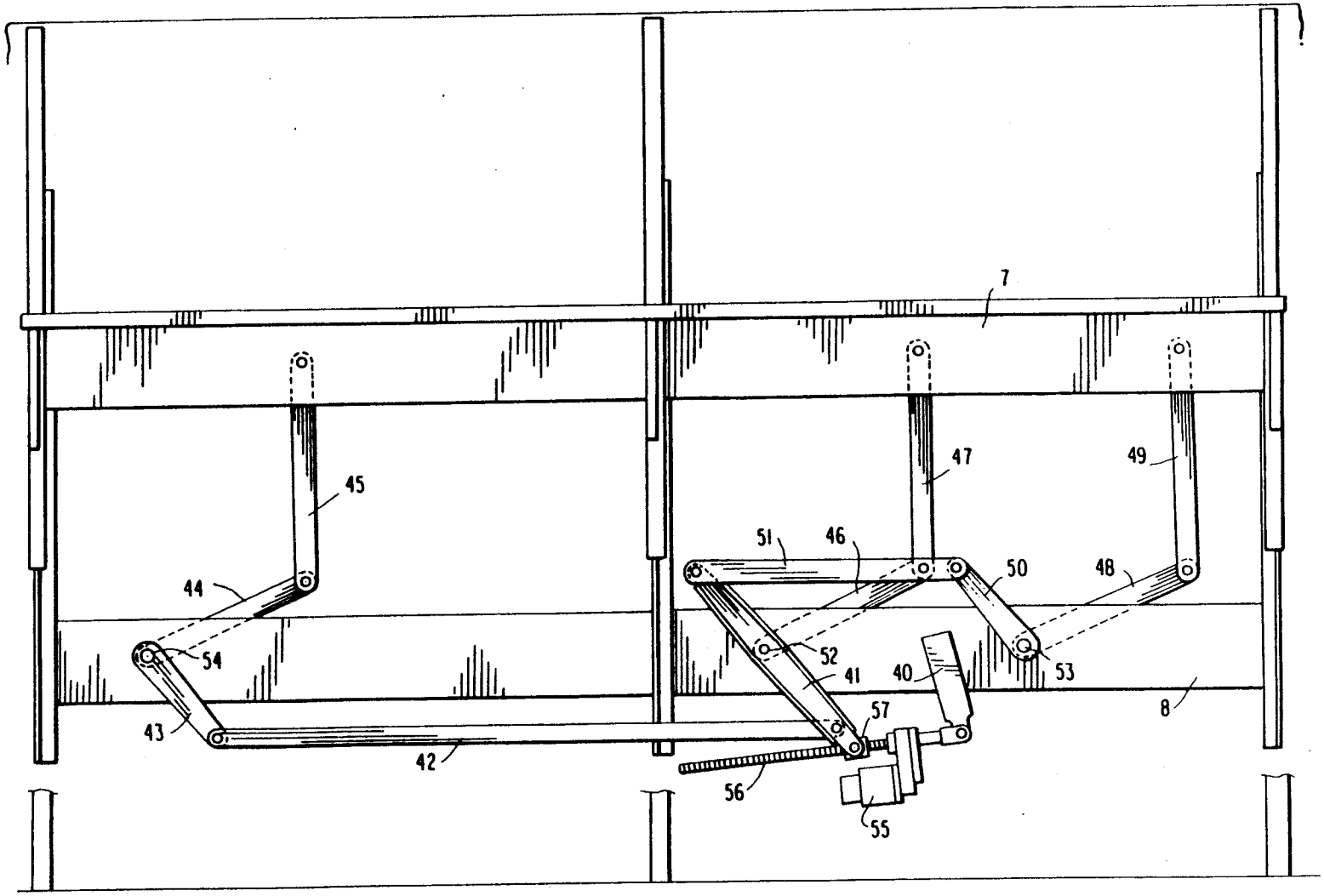

A further alternative is described as follows and illustrated in FIGS. 13 and 14, FIG. 13 illustrating the work surface in the lowermost position and FIG. 14 illustrating the work surface in the uppermost position. As shown in FIGS. 13 and 14, a linkage system is provided for causing the slidable channel to slide in the vertical direction and attendantly adjust the height of the work surface. Link 40 is stationarily secured to the fixed channel 8 and extends downwardly therefrom. The motor 55 is pivotably secured to an end of link 40 via rod 50 extending from the motor. The drive screw 56 extends in the opposite direction as the rod 50 and has a drive nut 57 threaded thereon. The drive nut 57 is secured to one end of first link 41 which is rotatably secured to the fixed channel 8 via pin 52 which extends through the fixed channel 8. Second link 46 is fixedly secured at one end thereof to pin 52 and extends substantially perpendicularly from the first link 41. Third link 47 is pivotably connected at one end thereof to the other end of second link 46 while the other end of third link 47 is pivotably connected to the slidable channel 7.

A fourth horizontal link 51 is connected at one end thereof to the other end of the first link 41 as shown in FIGS. 12 and 13. The other end of fourth link 51 is pivotably secured to an end of fifth link 50 which is pivotably secured at the other end to the fixed channel 8 via pin 53. Extending perpendicularly to the fifth link 50 is sixth link 48 which is fixedly secured to at one end to pin 53. The other end of sixth link 48 is pivotably secured to one end of seventh link 49, the other end of seventh link 49 being pivotably secured to the slidable channel 7. When the drive screw is rotated in a first direction so as to move the nut in the direction indicated by arrow A, the first link 41 is rotated counterclockwise as indicated by arrow B causing second link 46 to correspondingly rotate counterclockwise imparting an upward force on third link 47 to thereby move the slidable rail 7 upwardly. Additionally, when the first link 41 rotates counterclockwise, the fourth link 51 is translated in the direction of arrow C so as to cause the fifth link 50 and attendantly sixth link 48 to rotate counterclockwise, as shown by arrows D and E, respectively, to thereby impart an upward force on the seventh link 49 to assist in moving the slidable channel 7 upwardly.

If the width of the device necessitates, an additional linkage can be provided as shown in FIGS. 13 and 14. Specifically, as shown therein, an eighth link 42 is secured at one end thereof to an end of the first link 41 while the other end of eighth link 42 is pivotably secured to one end of ninth link 43. Ninth link 43 is pivotably secured to the fixed channel 8 via pin 54. Tenth link 44 is fixedly secured at one end thereof to the pin 54 so as to extend substantially perpendicularly from the ninth link 43. The other end of tenth link 44 is pivotably secured to an end of eleventh link 45 which is connected at the other end thereof to the slidable channel 7. Accordingly, when the first link 41 rotates counterclockwise, the eighth link 42 is translated in the direction of the arrow F causing the ninth link 43 and the tenth link 44 to rotate counterclockwise as indicated by arrow G, thereby imparting an upward force on the eleventh link 45 causing the slidable channel to move upwardly. In this manner, an upward force is imparted on the slidable channel uniformly along the length thereof such that the slidable channel will not experience binding even when an uneven load is provided on the work surface.

Figure 15:
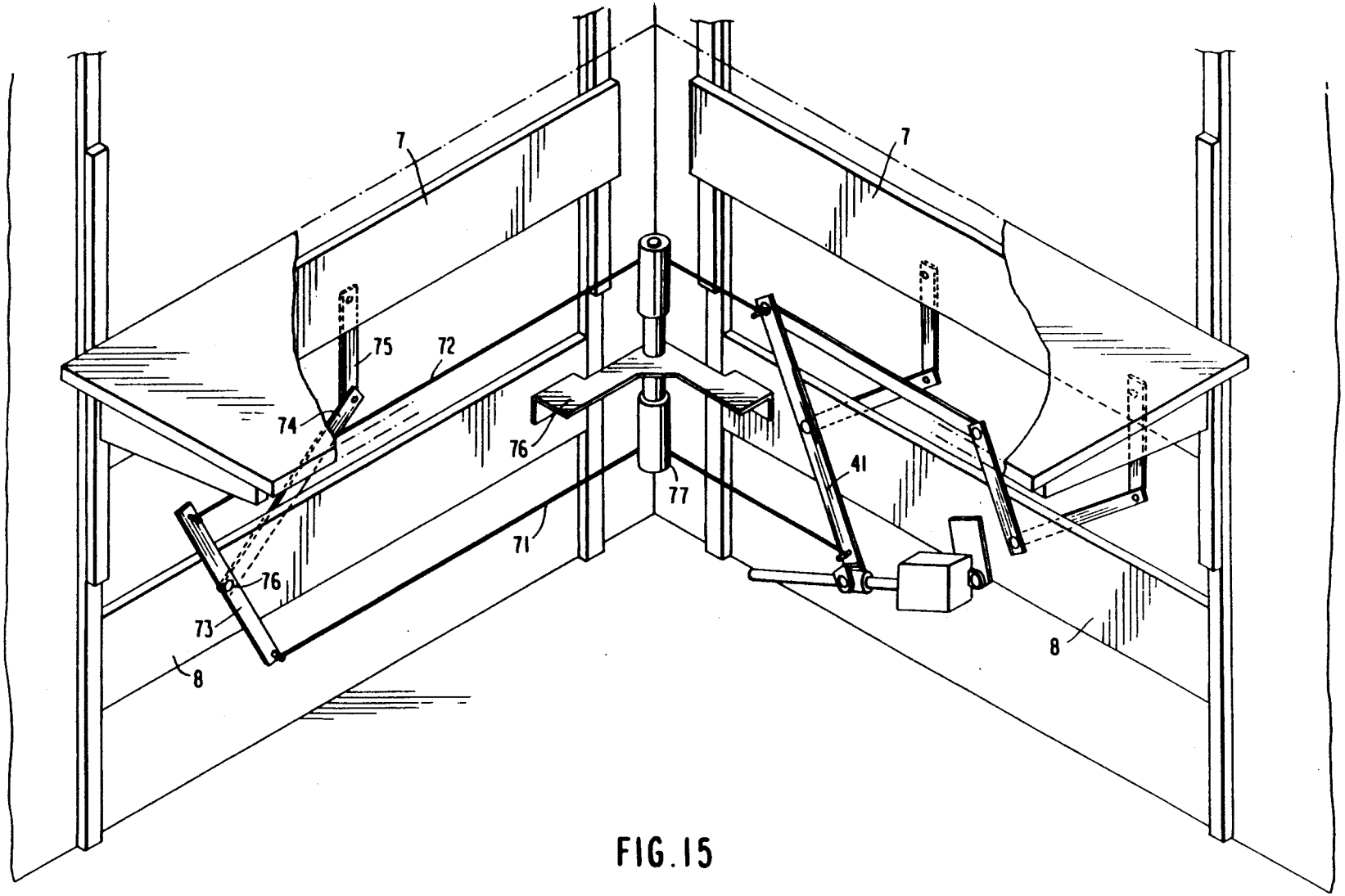
FIG. 15 is a perspective view of an L-shaped vertically adjustable work surface with a linkage/cable drive.

FIG. 15 illustrates an L-shaped work surface which is driven with a linkage system similar to that discussed above in regard to FIGS. 13 and 14. In particular, as shown therein, a roller bracket 76 rotatably supports rollers 77 in a vertically disposed manner at the corner of the L-shaped structure. A cable 71 connects the bottom portion of first link 41 to the bottom portion of twelfth link 73 via roller 77 while cable 72 connects the top portion of first link 41 to the top portion of twelfth link 73 via roller 77. The twelfth link 73 is pivotably secured at one end thereof to the fixed channel 8 via pin 76. Thirteenth link 74 is fixedly secured to the pin 76 such that it is rotatable with twelfth link 73. Finally, fourteenth link 75 is pivotably connected at one end thereof to the other end of thirteenth link 74 and to the slidable channel 7 at the other end thereof. Thus, when first link 41 is pivoted in a given direction, as described above, the cables 71, 72 cause the twelfth link 73 to rotate in the same direction causing the slidable channel 7 to move upwardly or downwardly via links 74, 75.

Figure 16:
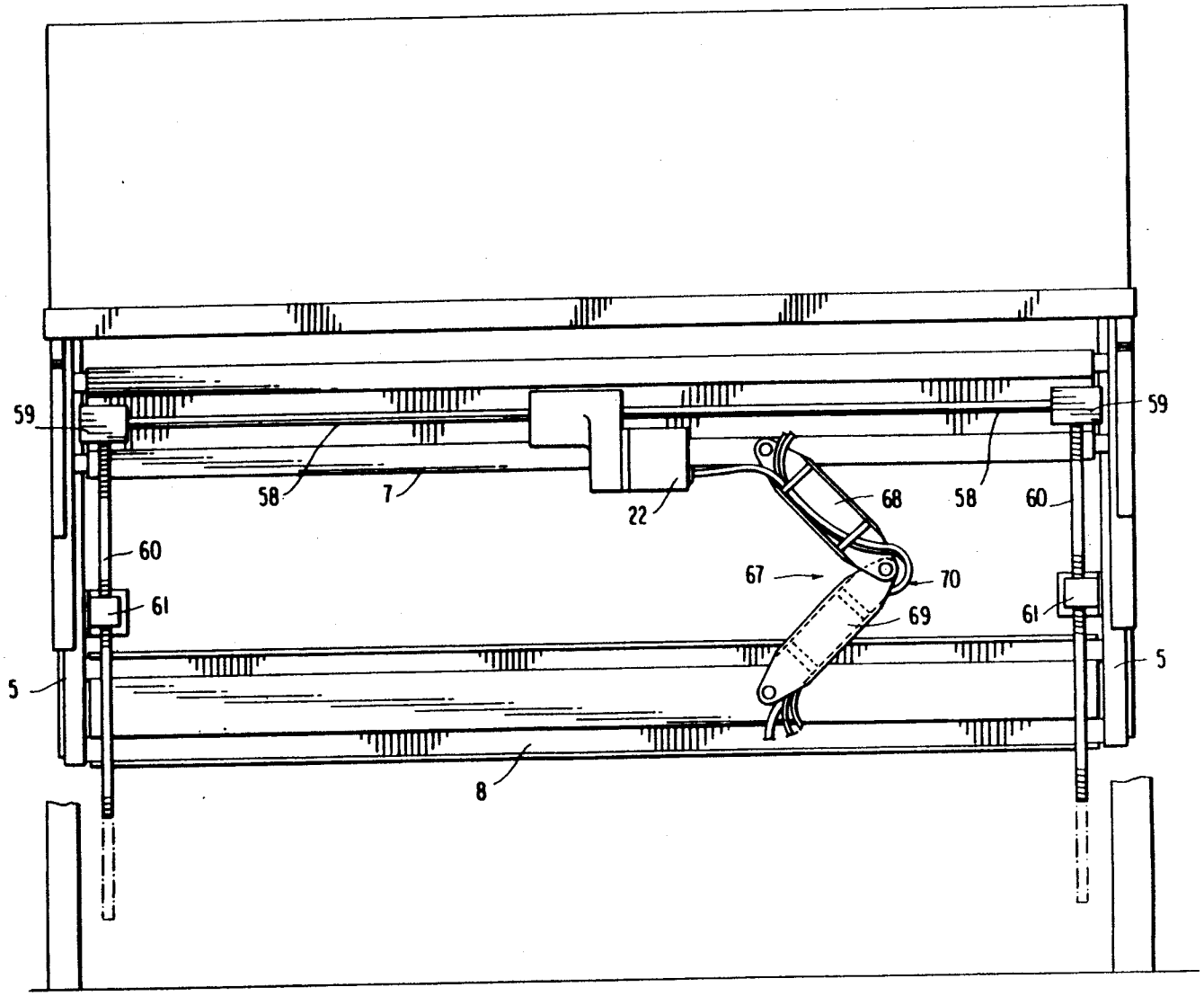
FIG. 16 is a front view of the vertically adjustable work station illustrating a dual drive screw arrangement for raising or lowering the work surface.

FIG. 16 illustrates an alternative driving/guide arrangement according to another embodiment of the invention. As shown in FIG. 16, the driving/guide mechanism includes a dual drive screw arrangement where drive screws 60 are respectively rotatably secured to opposing ends of the slidable channel 7 and are respectively threadedly engaged with drive nuts attached to opposing ends of the fixed channel 8.

More particularly, a motor 22 is fixedly secured to the slidable channel 7, and a connector rod 58 is rotatably attached to the motor such that the connector rod 58 extends parallel to the slidable channel 7 and to opposite ends thereof. A 90 degree bearing gear 59 is disposed on each end of the connector rod, proximate to opposing ends of the slidable channel 7. A drive screw 60 is rotatably, vertically disposed on each slidable rail 6 such that one end of each screw is attached to the bearing gear 59 and rotatably driven by rotation of the connector rod 58 via the bearing gear 59. One of the drive screws has a forward thread while the other drive screw has a reverse thread. Each of the drive screws is threadedly engaged with a drive nut 61 which is secured to each of the stationary rails 5. Alternatively, the drive nuts 61 can be secured to opposing ends of the fixed channel 8.

Accordingly, upon rotation of the connector rod 58 each of the drive screws 60 are caused to rotate via the respective bearing gears 59 in opposite directions. However, since the drive screws are threaded in an opposite manner with respect to one another, rotation of the drive screws causes the slidable channel 7, and attendantly the work surface 4, to be raised and lowered depending on the direction in which the motor is rotated.

Figure 17:
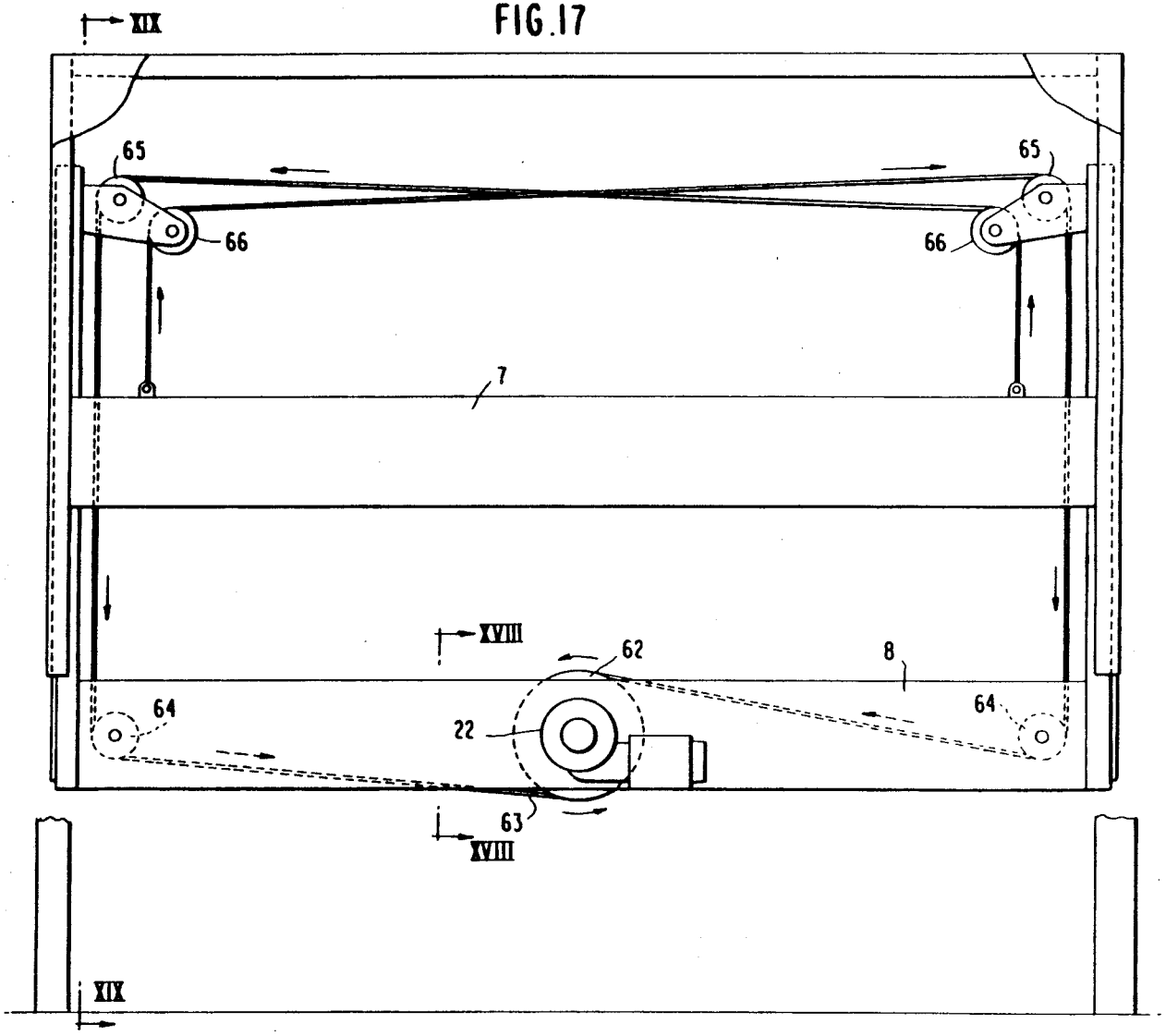
FIG. 17 is a front view of the vertically adjustable work station illustrating a pulley and cable method for raising and lowering the work surface.
Figure 18:
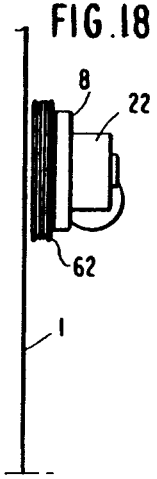
FIGS. 18 and 19 are sectional views of FIG. 17.
Figure 19:
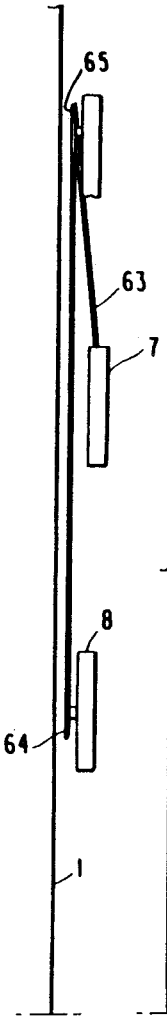

An alternative driving and guide mechanism for selectively moving the work surface upward and downward is shown in FIGS. 17–19. The drive mechanism consists of a motor 22, a take-up reel 62, a cable 63 wrapped around the reel 62 and pulleys 64, 65, and 66. The reel 62 is attached to the drive shaft of the motor 22 which is secured to the fixed channel 8. In particular, the motor 22 is secured to outside of the fixed channel 8 with the drive shaft extending therethrough and the reel 62 is fixedly secured to the drive shaft on the inside of the fixed channel 8, the inside being the side closest to the panel 1.

The cable 63 extends from the take-up reel 62 in the manner described below. Since both sides of the cable drive mechanism are identical, the description will be limited to the left side, as illustrated in FIG. 16. The cable 63 extends from the take-up reel 62, horizontally and parallel to the fixed channel 8, around first pulley 64 attached to the inside of the fixed channel 8 at the left side thereof. The cable then extends vertically upwardly, parallel to the stationary rail 5 and slidable reel 6 and around second pulley 65 attached to the top of the stationary rail 5. From second pulley 65, the cable extends horizontally, parallel to the work surface, around the third pulley 66 fixedly attached to the opposite stationary rail 5. Finally, the cable extends downwardly parallel to the stationary rail 5 and slidable rail 6 and is attached to the slidable channel 7 at one end thereof. The other end of the cable extends in the opposite manner so as to be connected to the other end of the slidable channel 7. In this manner, when the take up reel 62 rotates in a direction causing the cable 63 to wind therearound, the cable 63 pulls the slidable channel 7 and attendantly the work surface 4 upwardly. When the take-up 62 reel rotates in the opposite direction so as to unwind each end of the cable, gravity pulls the work surface downwardly.

Figure 20:
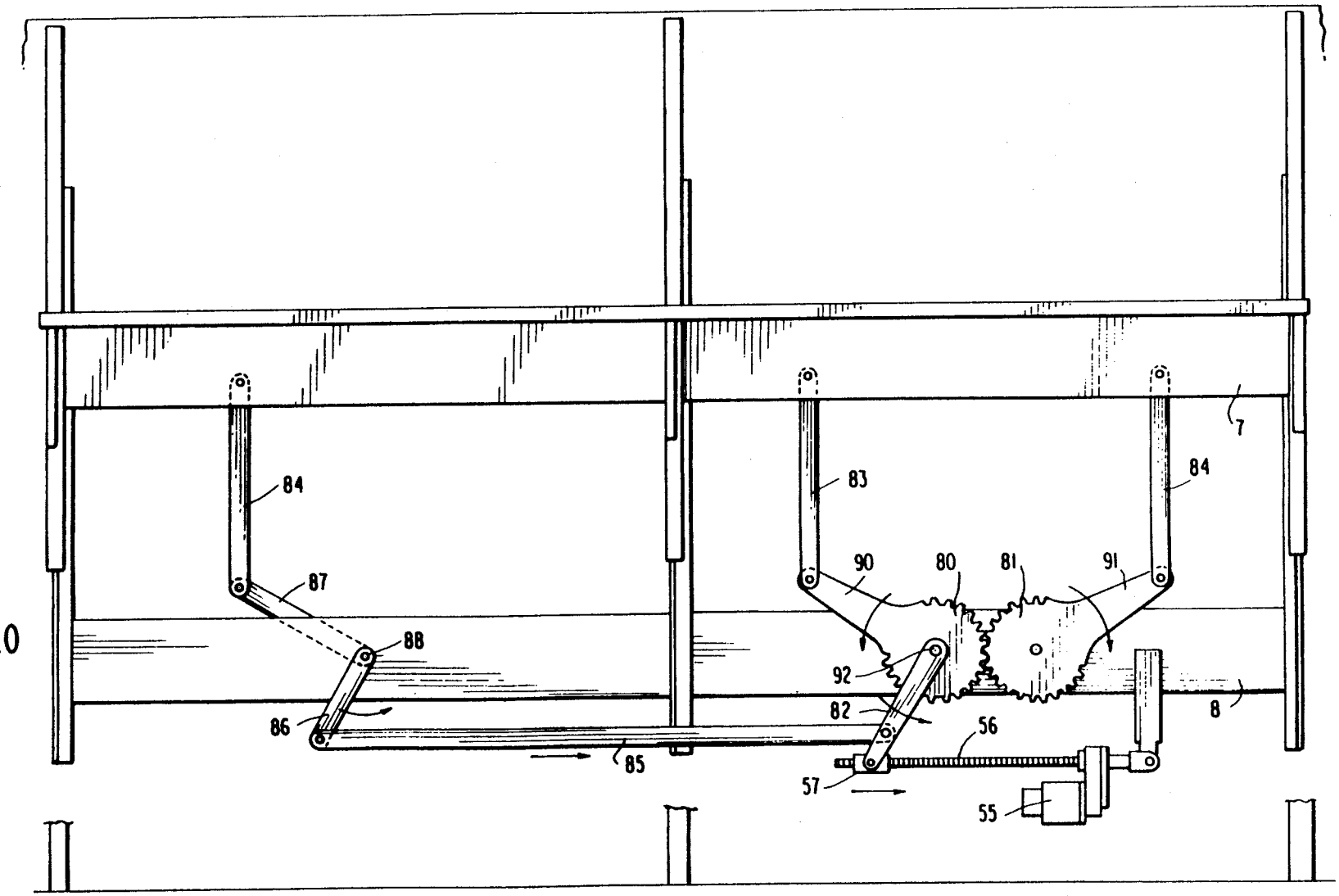
FIG. 20 is a front view of the vertically adjustable work station with a gear/linkage drive.
Figure 21:
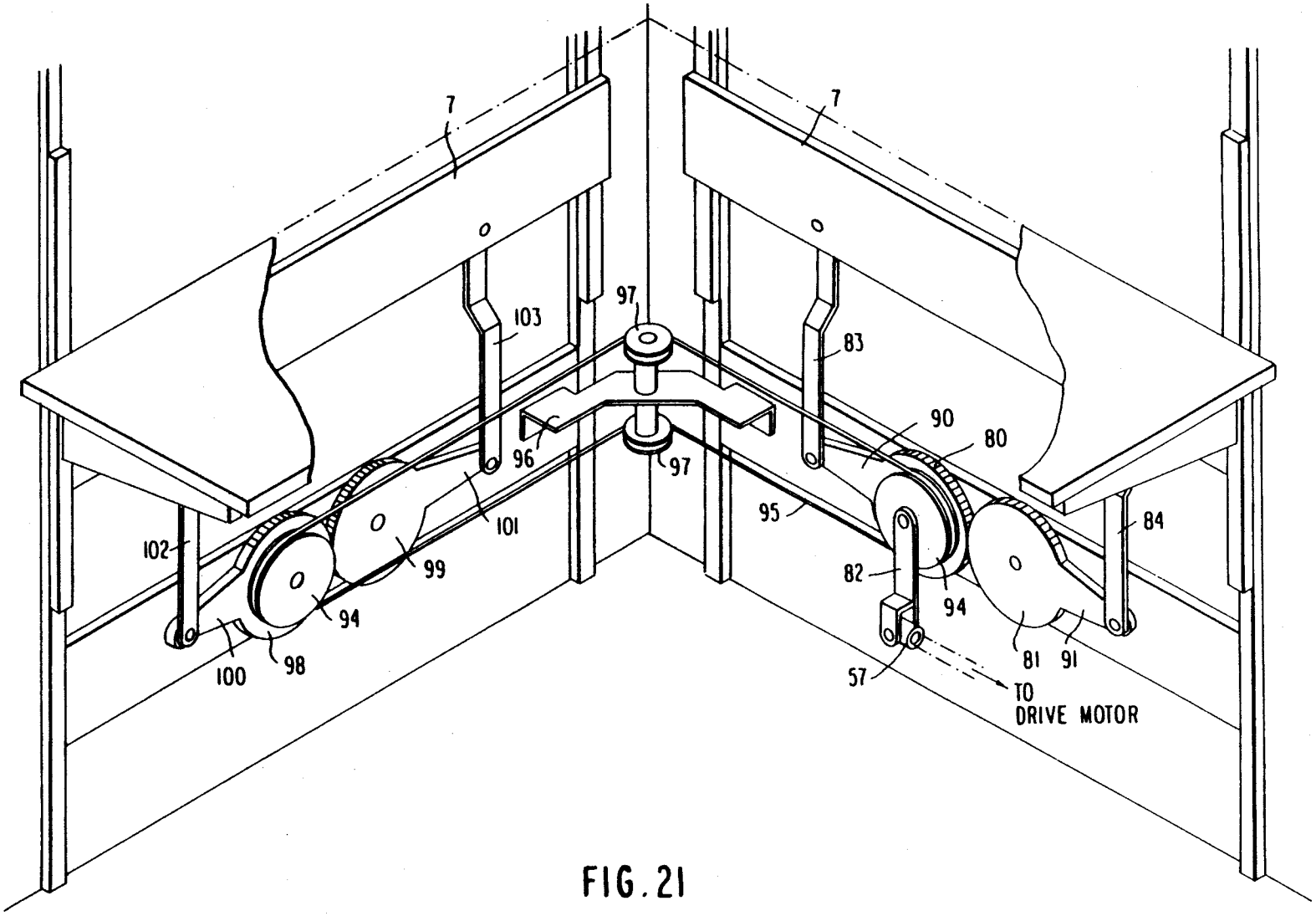
FIG. 21 is a perspective view of an L-shaped vertically adjustable work station with a gear/linkage drive.

An additional drive arrangement is illustrated in FIGS. 20 and 21. In particular, FIGS. 20 and 21 illustrate a gear/linkage drive system for raising and lowering the work surface. Referring to FIG. 20, a pair of first and second gears 80, 81 respectively having first and second arms 90, 91 extending therefrom are rotatably disposed on fixed channel 8 such that their respective teeth are engaged with one another. A link 82 is pivotably secured at one end thereof to the drive nut 57 and at the other end thereof to the slidable channel 8 via pin 92. The first gear 80 is fixably secured to the pin 92 such that pivotable movement of link 82 causes the first gear 80 to rotate correspondingly. Further, since the teeth of first gear 80 are engaged with the teeth of second gear 81, the second gear 81 rotates in correspondence with the rotation of first gear 80. A link 83 is pivotably secured at one end thereof to the end of first arm 90 and at the other end thereof to the slidable channel 7. Correspondingly, link 84 is pivotably secured at one end thereof to the end of second arm 91 and at the other end thereof to the slidable channel 7. Thus, when the drive screw 56 is rotated by motor 55 causing the drive nut to translate therealong in the direction indicated by the arrow, the link 82 rotates counter clockwise causing first gear 81 to rotate counter clockwise and second gear 80 to rotate clockwise, as illustrated by the arrows in FIG. 20. In this manner, the slidable channel 7 is moved downwardly by means of links 83, 84 respectively connected to arms 90, 91.

When the width of the work surface requires, an additional linkage system is provided for supporting the additional width of the work surface. In particular, as illustrated in FIG. 20, a link 85 is pivotably connected to the bottom portion of link 82 at one end thereof and to a link 86 at the other end thereof. The link 86 is pivotably secured to the fixable channel 8 by means of pin 88. Correspondingly, link 87 is fixably secured at one end thereof to pin 88 and pivotably secured at the other end thereof to link 89 which is pivotably secured to the slidable channel 7. Thus, when the drive nut is translated in the direction of the arrow, link 85 is moved in the direction indicated by the arrow causing links 86 and 87 to rotate counter clockwise, as illustrated by the arrow in FIG. 20. In this manner, link 89 causes the slidable channel to be moved downwardly.

FIG. 21 is a perspective view illustrating the drive mechanism for raising and lowering an L-shaped work surface. The linkage arrangement is the same as the linkage arrangement discussed above in regard to FIG. 20. In particular, the gear/linkage arrangement is provided for both sides of the L-shaped work surface, as illustrated in FIG. 21. The right side includes first and second gears 80, 81 respectively having first and second arms 90, 91 extending therefrom which are respectively connected to links 83, 84. The left side has a similar arrangement including third and fourth gears 98, 99 respectively having third and fourth arms 102, 103 extending therefrom. The third and fourth arms 102, 103 are pivotably connected to the slidable channel 7 to allow for vertical movement.

The first gear 80 and third gear 98 have pulleys 94 fixedly attached thereto so as to be rotatable therewith. Pulleys 97 are supported by bracket 96 at the corner of the L-shape configuration. An endless belt 95 is provided around pulleys 94 and 97 so as to rotatably connect first gear 80 with third gear 98 as shown in FIG. 21. Therefore, when first gear 80 is rotated in the manner discussed above, the pulley/belt system causes the third gear 98 to rotate via pulley 94. Due to the meshing engagement of the teeth of third and fourth gears 98, 99, rotation of third gear 98 causes fourth gear 99 to rotate as well attendantly causing the slidable channel to move vertically.

Additional features of the invention are described below.

A top cover 30 is provided above the work surface, as shown in FIG. 3. Specifically, the top cover 30 is connected at opposing lateral sides to the top of each slidable rail 6 and extends downwardly just below the work surface 4. Disposed on the top cover is the elevation adjustment switch 31 for selectively operating the motor to vertically displace the work surface to the desired elevation. Also disposed on the upper cover are the necessary VDT hook-up connections 32 as well as an electrical outlet 33. In addition, a lower skirt is disposed below the work surface to cover the portion of the drive mechanism which is not covered by the cover 26.

A wire guide device 67 is provided to assure that the wires supplying the electrical outlet 33, the VDT connection 32 and the motor do not become entangled in the drive mechanism and become damaged. The metal guide 67 is substantially clam shaped and includes two first and second arms 68, 69 and hinge 70, as illustrated in FIG. 16. The first and second arms 68, 69 are respectively connected at one end thereof to the slidable channel 7 and the fixed channel 8. The other ends of the first and second arms 68, 69 are pivotably secured to one another to form hinge 70. Thus, first and second arms 68, 69 are separated from one another as the slidable channel 7 moves away from the fixed channel 8, and approach one another when the slidable channel 7 moves toward the stationary channel 8. The supply wires 71 are secured to the wire guide in the manner illustrated in FIG. 16. Therefore as the slidable channel 7 moves up and down the wires are prevented from experiencing excessive bending over the range of the work surface's travel so that the wires do not become damaged.

Having fully described the details of the invention, the retrofit procedure will be described hereinafter. Referring to FIG. 1, the desk top 11 and the existing support brackets 3 are removed from the existing vertical support rails 2. Thereafter, as illustrated in FIG. 3, the retrofittable device is attached to the existing rail 2 by securing the engagement teeth 10 of each of the stationary rails 5 into the slots of the existing support rails 2.

While the desk top can be automatically adjusted by a distance of twenty inches using the automatic drive mechanism, the retrofittable device can be secured at any elevation along the existing rails. For instance, the standard table top height is 30¼'. Thus, it may be desirable to attach the retrofittable device to the existing rails such that the table top can be adjusted 10 inches in both the up and down direction with respect to the standard 30¼' table top height; thus, the table top can be automatically adjusted from 20¼' to 40¼'.

Having secured the retrofittable device to the existing panel 1, the existing support brackets 3 are attached to the slidable rails 6 of the retrofittable device in the same manner that the support brackets 3 and normally attached to the existing rails 2. That is, the engagement teeth 17 of the existing support brackets 3 are inserted into the slots 16 of the slidable rails 6 so as to be securely attached thereto. It should be noted that the support brackets 3 can be attached at various elevations along the slidable rails 6 providing an additional adjusting feature. Once the support brackets are attached to the sliding brackets, the table top 4 is placed on top of the support brackets 3 in the usual manner.

Although the present invention describes the preferred embodiment of the invention, it should be understood that numerous modifications and adaptations may be resorted to without departing from the spirit of the invention. For instance, an emergency cut-off switch may be provided to prevent accidental vertical movement of the work surface.

Thus, the retrofittable work station according to the invention provides a solution to the problems associated with the conventional work stations discussed hereinabove. While the conventional work stations included substantially fixed, non-adjustable work surfaces resulting in stress related health problems for the VDT users, the invention provides a retrofittable work station having an automatically adjustable work surface to accommodate users of various heights to thereby provide a comfortable, substantially stress free working environment.

What is claimed:

1. A vertically adjustable, work station mounted to a wall panel, comprising:

a first pair of horizontally spaced, vertically oriented stationary rails secured to said wall panel;

a work surface;

a pair of support brackets for supporting said work surface;

a second pair of elongate, vertically oriented, rails individually slidably mounted to said first pair of support rails, respectively;

means for individually mounting said support brackets and thus said work surface to said second pair of rails;

an elongate, horizontally oriented, movable channel member interconnecting said second pair of rails; and drive means coupled between said panel and said channel member for selectively displacing said channel member upward or downward to attendantly vertically displace the work surface.

2. The work station of claim 1, further comprising an elongate, horizontally oriented, fixed channel member interconnecting said first pair of rails.

3. The work station of claim 2, wherein said drive means includes a linkage means for uniformly raising and lowering the work surface.

4. The work station of claim 2, wherein said drive means comprises:

an elongate vertically extending drive screw rotatably secured to one of said movable and fixed channel members;

a threaded nut fixedly secured to another of said movable and fixed channel members, said drive screw being threadedly engaged with said nut; and means for rotating said drive screw relative to said nut such that said drive screw and said nut move toward or away from one another to attendantly vertically displace the work surface.

5. The work station of claim 2, wherein said drive means comprises:

a pair of drive screws respectively, rotatably and vertically disposed on opposing ends of one of said movable channel member and said fixed channel member;

a pair of threaded nuts respectively secured to opposing ends of another of said movable channel member and said fixed channel member, said drive screws being respectively threadedly engaged with said drive nuts; and means for rotating said drive screws relative to said drive nuts such that said drive screws and said drive nuts move toward and away from one another to attendantly vertically displace the work surface.

6. The work station according to claim 2, wherein said drive means comprises:

take-up reel rotatably disposed on one of said fixed channel member and said movable channel member;

a cable wound around said reel, opposite ends of said cable extending from said reel; and means for leading said opposite ends of said cable to another of said fixed channel member and said movable channel member such that when said cable is wound around said reel, said movable channel member, and attendantly said work surface, is raised, and when said cable is unwound from said reel, said movable channel member, and attendantly said work surface, is lowered.

7. The work station of claim 1, wherein each of said second rails includes one of a plurality of slots vertically disposed therealong and each of said support brackets includes another of said plurality of slots and said plurality of teeth-like projections vertically disposed therealong wherein said protrusions are insertable into said slots to stationarily individually mount said support brackets to said second rails.

8. The work station of claim 1, wherein each of said rails of said first and second pairs of rails are substantially G-shaped in cross-section and wherein said second pair of rails are individually slidably interconnected to said first pair of rails with a substantially frictionless member interlocked therebetween.

9. The work station of claim 2, further comprising means for wire guiding means for guiding wires being supplied to equipment on said work surface.

10. The work station of claim 9, wherein said wire guiding means comprises:

a first arm having one end pivotably connected to said movable channel member;

a second arm having one end pivotably connected to said fixed channel member;

hinge means for pivotably securing another end of said first arm to another end of said second arm; and means for securing said wires to said first and second arms such that said wire runs from said one end of said second arm to said hinge means and continues to said one end of said first arm.

11. A vertical adjustable work station adapted to be mounted to a wall panel having at least a pair of horizontally spaced vertically oriented support rails secured thereto, comprising:

a work surface;

a pair of support brackets for supporting said work surface;

a first pair of elongate, vertically oriented rails horizontally displaced from one another and adapted to be individually and stationarily mounted to the support rails;

a second pair of elongate, vertically oriented rails individually slidably mounted to said first pair of rails;

means for individually mounting said support bracket and thus said work surface to said second pair of rails;

a first elongate, horizontally oriented channel member interconnecting said first pair of rails;

a second elongate, horizontally oriented channel member interconnecting said second pair of rails; and drive means coupled between said first and second channel members for selectively displacing said channel members towards and away from each other to attendantly vertically displace the work surface, said driving means including a linkage means for coupling said first channel member to said second channel member.

12. A vertical adjustable work station adapted to be mounted to a wall panel having at least a pair of horizontally spaced vertically oriented support rails secured thereto, comprising:

a work surface;

a pair of support brackets for supporting said work surface;

a first pair of elongate, vertically oriented rails horizontally displaced from one another and adapted to be individually and stationarily mounted to the support rails;

a second pair of elongate, vertically oriented rails individually slidably mounted to said first pair of rails;

means for individually mounting said support bracket and thus said work surface to said second pair of rails;

a first elongate, horizontally oriented channel member interconnecting said first pair of rails;

a second elongate, horizontally oriented channel member interconnecting said second pair of rails; and drive means coupled between said first and second channel members for selectively displacing said channel members towards and away from each other to attendantly vertically displace the work surface, said driving means including a pair of drive screws respectively, rotatably and vertically disposed on opposing ends of one of said channel members, a pair of threaded nuts respectively secured to opposing ends of another of said channel members, said drive screws being respectively threadedly engaged with said drive nuts and means for rotating said drive screws relative to said drive nuts such that said drive screws and said drive nuts move toward and away from one another to attendantly vertically displace the work surface.

13. A vertical adjustable work station adapted to be mounted to a wall panel having at least a pair of horizontally spaced vertically oriented support rails secured thereto, comprising:

a work surface;

a pair of support brackets for supporting said work surface;

a first pair of elongate, vertically oriented rails horizontally displaced from one another and adapted to be individually and stationarily mounted to the support rails;

a second pair of elongate, vertically oriented rails individually slidably mounted to said first pair of rails;

means for individually mounting said support bracket and thus said work surface to said second pair of rails;

a first elongate, horizontally oriented channel member interconnecting said first pair of rails;

a second elongate, horizontally oriented channel member interconnecting said second pair of rails; and drive means coupled between said first and second channel members for selectively displacing said channel members towards and away from each other to attendantly vertically displace the work surface, said driving means including a take-up reel rotatably disposed on one of said channel members, a cable wound around said reel, opposite ends of said cable extending from said reel and means for leading said opposite ends of said cable to another of said channel members such that when said cable is wound around said reel, said second channel member, and attendantly said work surface, is raised, and when said cable is unwound from said reel, said second channel member, and attendantly said work surface, is lowered.

14. A vertical adjustable work station adapted to be mounted to a wall panel having at least a pair of horizontally spaced vertically oriented support rails secured thereto, comprising:

a work surface;

a pair of support brackets for supporting said work surface;

a first pair of elongate, vertically oriented rails horizontally displaced from one another and adapted to be individually and stationarily mounted to the support rails;

a second pair of elongate, vertically oriented rails individually slidably mounted to said first pair of rails;

means for individually mounting said support bracket and thus said work surface to said second pair of rails;

a first elongate, horizontally oriented channel member interconnecting said first pair of rails;

a second elongate, horizontally oriented channel member interconnecting said second pair of rails; and drive means coupled between said first and second channel members for selectively displacing said channel members towards and away from each other to attendantly vertically displace the work surface, said driving means including gear means disposed on said first channel member, gear rotating means for rotating said gear means and linkage means connecting said gear means to said second channel member for transmitting rotation of said gear means to vertical displacement of said second channel member and attendantly said work surface.

15. The vertical adjustable work station of claim 14, wherein said gear means includes a pair of gears rotatably disposed on said first channel member in engagement with one another, each of said gears having an arm extending therefrom connected to said linkage means.

16. A vertically adjustable L-shaped work station adapted to be mounted to an L-shaped wall panel having a pair of horizontally spaced vertically oriented support rails secured to each wall of said L-shaped panel, comprising:

an L-shaped work surface;

support brackets for supporting said work surface;

first pairs of elongate, vertically oriented rails horizontally displaced from one another and adapted to be individually and stationarily mounted to each of said pair of support rails;

second pairs of elongate, vertically oriented rails individually slidably mounted to each of said first pairs of rails;

means for mounting said support brackets and thus said work surface to each of said second pairs of rails;

first elongate, horizontally oriented channel members interconnecting each of said pairs of rails;

second elongate, horizontally oriented channel members interconnecting each of said second pairs of rails; and drive means coupled between said first and second channel members for selectively displacing said channel members towards and away from each other to attendantly vertically displace the work surface.

17. The vertical adjustable work station of claim 16, wherein said driving means comprises a pair of linkage means and a cable means, one of said linkage means coupling one of said first channel members to one of said second channel member and another of said linkage means coupling another of said first channel members to another of said second channel members and said cable means connecting said pair of linkage means such that movement of said one linkage means causes movement of said second linkage means.

18. The vertical adjustable work station of claim 16, wherein said driving means comprises:

gear means disposed on each of said first channel members;

gear rotating means for rotating one of said gear means;

cable means interconnecting said gear mean for rotating another of said gear means in response to rotation of said one gear means; and linkage means connecting each of said gear means to each of said second channel members for transmitting rotation of each of said gear means to vertical displacement of each of said second channel members and attendantly said L-shaped work surface.

19. A vertically adjustable work station adapted to be mounted to a support means, comprising:

a first pair of horizontally spaced, vertically oriented stationary support rails adapted to be secured to the support means;

a work surface;

a pair of support brackets for supporting said work surface;

a second pair of elongate, vertically oriented, rails individually slidably mounted to said first pair of support rails, respectively;

means for individually mounting said support brackets and thus said work surface to said second pair of rails;

an elongate, horizontally oriented, movable channel member interconnecting said second pair of rails; and drive means coupled between the support means and said channel member for selectively displacing said channel member upward or downward to attendantly vertically displace the work surface.

20. The work station of claim 19, further comprising an elongate, horizontally oriented, fixed channel member interconnecting said first pair of rails.

21. The work station of claim 20, wherein said drive means includes a linkage means for uniformly raising and lowering the work surface.

* * * * *